United States Patent [19]

Cancilla

[11] 3,972,509

[45] Aug. 3, 1976

[54] HYDRAULIC JACK INCORPORATING ROTATABLE POWER TRAIN IN PUMP ASSEMBLY

[76] Inventor: Philip S. Cancilla, 342 Ann Darling Drive, San Jose, Calif. 95133

[22] Filed: Oct. 2, 1975

[21] Appl. No.: 618,963

[52] U.S. Cl. ..... 254/93 H

[51] Int. Cl.[2] ..... B66F 3/24

[58] Field of Search ..... 254/93 H, 93 R

[56] References Cited

UNITED STATES PATENTS

| | | | |
|---|---|---|---|
| 2,070,935 | 2/1937 | Traut | 254/93 R |
| 2,253,347 | 8/1941 | Plymesser | 254/93 H |
| 3,806,091 | 4/1974 | Wride | 254/93 R |

FOREIGN PATENTS OR APPLICATIONS

| | | | |
|---|---|---|---|
| 930,757 | 2/1948 | France | 254/93 R |
| 571,074 | 8/1945 | United Kingdom | 254/93 H |

*Primary Examiner*—Al Lawrence Smith
*Assistant Examiner*—Robert C. Watson
*Attorney, Agent, or Firm*—John J. Leavitt

[57] ABSTRACT

Presented is a hydraulic jack structure incorporating an actuating assembly which mutiplies the mechanical advantage between the handle and the pump of the hydraulic jack. A power train is provided interposed between the handle assembly and the pump assembly, increasing the mechanical advantage between the handle and the pump assembly in the order of about 10-to-1. For greater flexibility and convenience during use, the handle assembly, including the power train disposed between the pump assembly and the handle, are mounted so as to be positionally adjusted in relation to the base of the hydraulic jack.

9 Claims, 7 Drawing Figures

HYDRAULIC JACK INCORPORATING ROTATABLE POWER TRAIN IN PUMP ASSEMBLY

BACKGROUND OF THE INVENTION

One of the disadvantages that has been paramount in connection with the use of hydraulic jacks has been the fact that the lifting capacity of the hydraulic jack has been limited by the amount of pressure that the user places on the handle of the jack. By their construction, hydraulic jacks can normally lift much heavier loads than has been thought possible. The limiting factor has been that the operator of the jack could not place sufficient force on the pump to raise such heavier loads. Accordingly, one of the principal objects of the invention is to interpose a power train between the handle of the hydraulic jack and the pump assembly so as to increase the mechanical advantage of the operator.

In another aspect of the invention, it is frequently desirable that the position of the handle in relation to the jack structure be movable so as to provide clearance for operation of the jack handle. In conventional jacks, one end of the handle assembly is normally pivoted to the jack structure while an intermediate point is pivoted to the pump assembly, and no provision is made for altering the position of the jack handle horizontally in relation to the body of the jack. Accordingly, a still further object of the invention is the incorporation of a power train between the handle of a hydraulic jack and the pump assembly designed in such a way that the entire power train and handle assembly may be rotated about a vertical axis so as to change the relationship between the handle assembly and the jack structure.

The invention possesses other objects and features of advantage, some of which, with the foregoing, will be apparent from the following description and drawings. It is to be understood however that the invention is not limited to the embodiment illustrated and described, since it may be embodied in various forms within the scope of the appended claims.

SUMMARY OF THE INVENTION

In terms of broad inclusion, the invention comprises a hydraulic structure, conveniently of the portable jack type having a base on which is mounted a hydraulic cylinder within which operates a hydraulic ram moved by pressure applied to hydraulic fluid in a pump assembly. Hydraulic fluid is pumped from the pump assembly into a chamber below the hydraulic ram, and the hydraulic ram is elevated in proportion to the volume of hydraulic fluid forced into the chamber. The force required to actuate the pump is proportional to the diameter of the pump cylinder and the ram cylinder and the load attempted to be lifted or force applied by the hydraulic ram. A power train is provided interposed between the handle assembly and the pump assembly, increasing the mechanical advantage between the handle and the pump assembly in the order of about 10-to-1. For greater flexibility and convenience during use, the handle assembly, including the power train disposed between the pump assembly and the handle, are mounted so as to be positionally adjusted in relation to the base of the hydraulic jack.

DESCRIPTION OF THE PREFERRED EMBODIMENT

Figure 1:
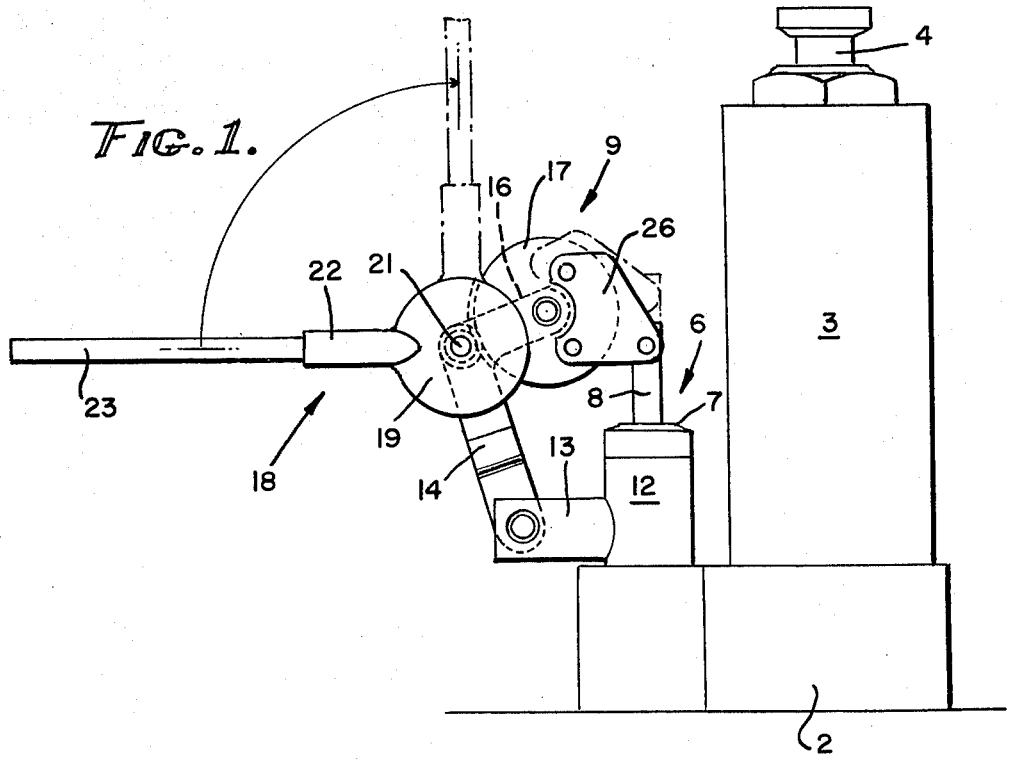
FIG. 1 is a side elevational view of the invention as applied to a hydraulic jack structure.
Figure 2:
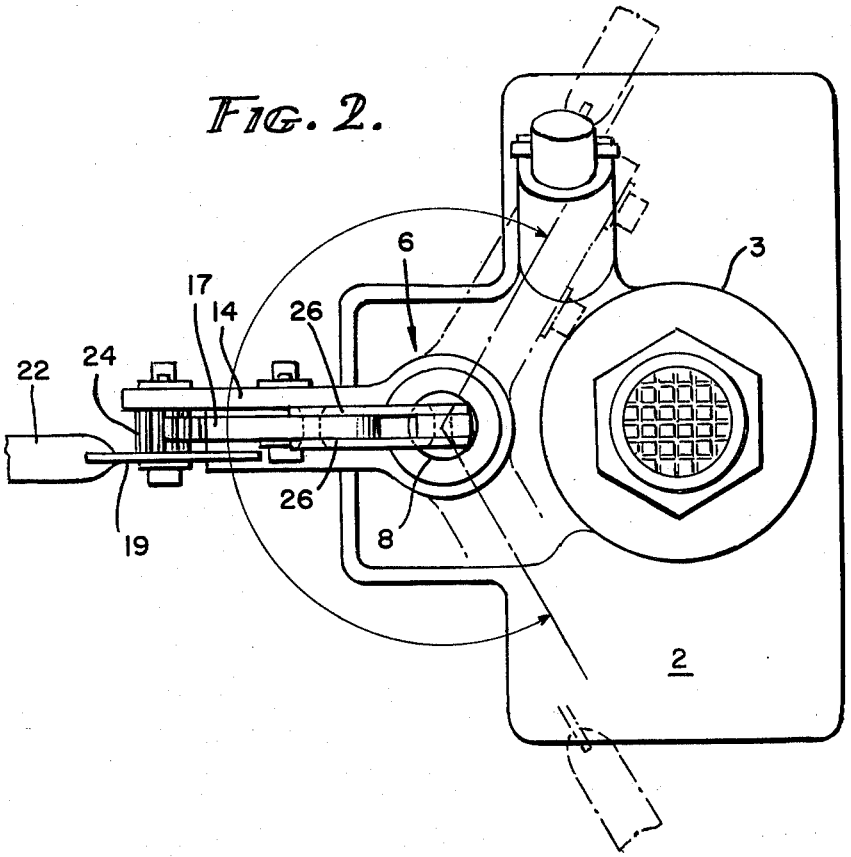
FIG. 2 is a plan view of the hydraulic jack structure illustrated in FIG. 1.

In terms of greater detail, the hydraulic structure of the invention is described for convenience as applied to a jack, and comprises a base 2 having mounted thereon a high pressure cylinder 3 within which is adapted to operate a hydraulic ram 4 in the conventional manner. Mounted on the base of the hydraulic jack is a pump assembly designated generally by the numeral 6 and including a pump cylinder 7 and a pump ram 8. The pump ram is reciprocable so as to cause displacement of the piston attached thereto (not shown), which works within the cylinder 7 to impose pressure upon fluid disposed below the piston, causing the fluid to flow into the main pressure cylinder 3 below the ram 4.

This construction is conventional, and no claim is made thereto. As is known, the amount of force required to be imposed on the ram 8 of the pump assembly is proportional to the cross-sectional areas of the ram 4 operating in cylinder 3 and the load attempted to be lifted by the ram 4. Obviously, the greater the load the more force is required on the ram 8. It has been found that one of the limiting factors in the use of a hydraulic jack, even a small portable jack, is the force which may be conveniently exerted on the ram 8. Small portable jacks are equipped with small handles of short length, thus determining the mechanical advantage between the handle and the pump assembly. In the present instance, additional mechanical advantage is provided by a power train assembly designated generally by the numeral 9 amd mounted on the pump cylinder 7 by means of a collet 12 having a laterally projecting lug 13 on which is pivotally mounted a link 14. The link is generally L shaped, having a leg 16 as shown on the end of which is pivotally mounted a gear segment 17. Also pivotally mounted on the link 14 at the intersection of the legs 14 and 16 is a handle assembly designated generally by the numeral 18 and having a plate 19 pivotally mounted on a pivot pin 21 journaled on link 14. The plate 19 is integral with a socket portion 22 into which may be detachably inserted a handle 23.

Figure 4:
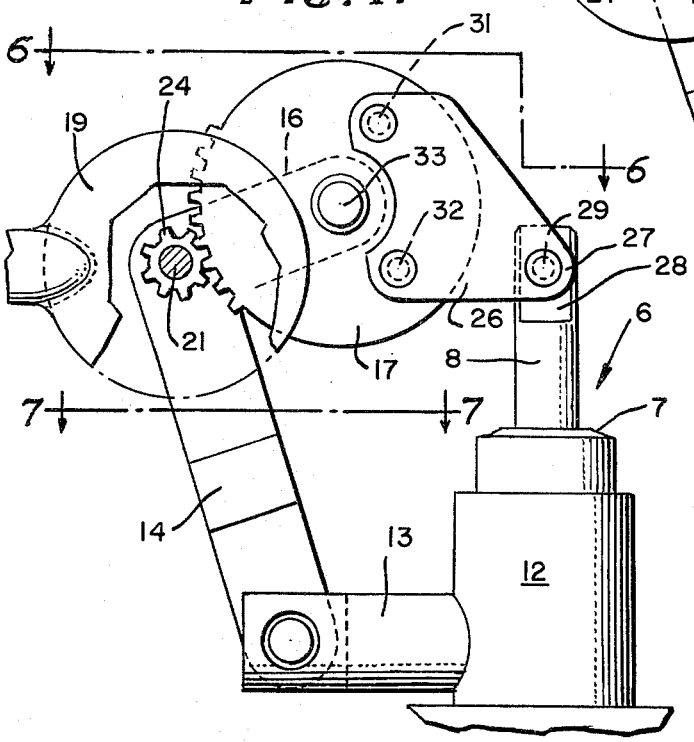
FIG. 4 is a fragmentary elevational view showing the power train and pump assembly in their relative positions after the handle has been pivoted downwardly through 90° from the position illustrated in FIG. 3.
Figure 5:
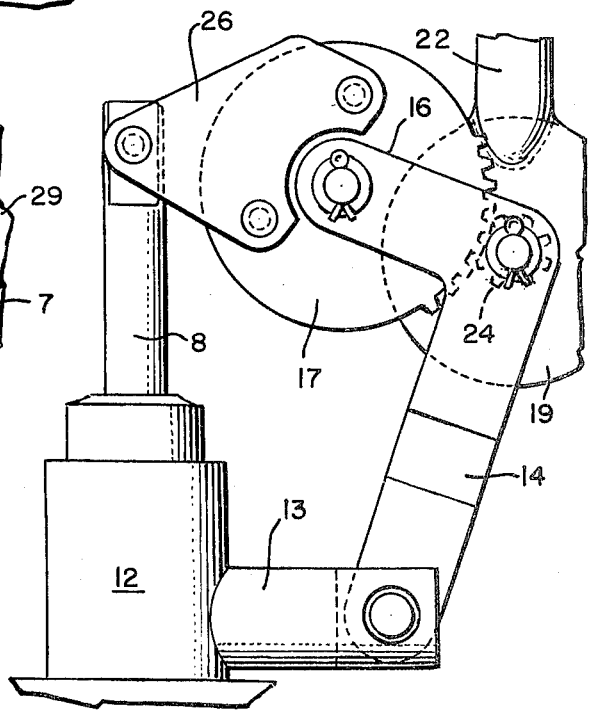
FIG. 5 is a fragmentary elevational view similar to FIG. 3 but showing the opposite side of the power train.
Figure 6:
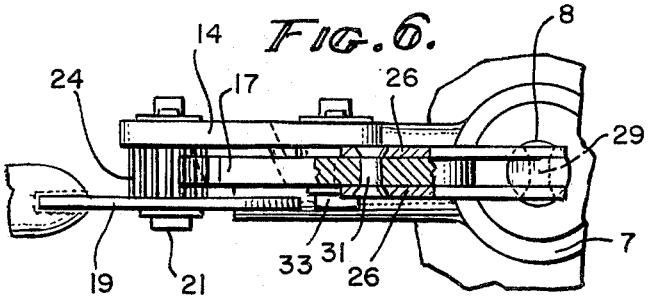
FIG. 6 is an enlarged fragmentary view in plan and partly in section of the power train mechanism taken in the direction of arrows 6—6 in FIG. 4.
Figure 7:
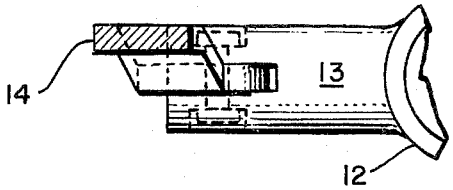
FIG. 7 is a horizontal sectional view taken in the plane indicated by the line 7—7 in FIG. 4.

Mounted on the plate 19 for rotation on the pivot pin 21 is a drive gear 24 the teeth of which mesh with the teeth in gear segment 17. It will be noted from FIG. 4, that the gear segment 17 has a much longer periphery than the periphery of the gear 24, with the effect that rotation of the gear 24 through a considerable arc, say 90° as illustrated in FIG. 1, causes a considerably smaller degree of rotation of the gear segment 17. This results in approximately a 10-to-1 mechanical advantage between the pressure applied to the handle 23 and the pressure applied to the pump shaft 8.

Such force is applied to pump shaft 8 through a pressure plate 26 having a generally triangular configuration with the apex portion 27 of the plate being pivoted to the upper end 28 of the pump shaft 8 by an appropriate hardened pivot pin 29. At its opposite end, the pressure plate extends on opposite sides of the gear segment 17 and is rigidly secured thereto by pins 31 and 32 as shown. It will be noted that the pin 33 on which the gear segment 17 is pivoted on the arm 16 is radially spaced from the anchor pins 31 which secure the pressure plate to the gear segment. Because of this offset attachment of the pressure plate to the gear segment, rotation of the gear segment causes rotary displacement of the pressure plate, which in turn cause axial displacement of the pump ram 8.

Figure 3:
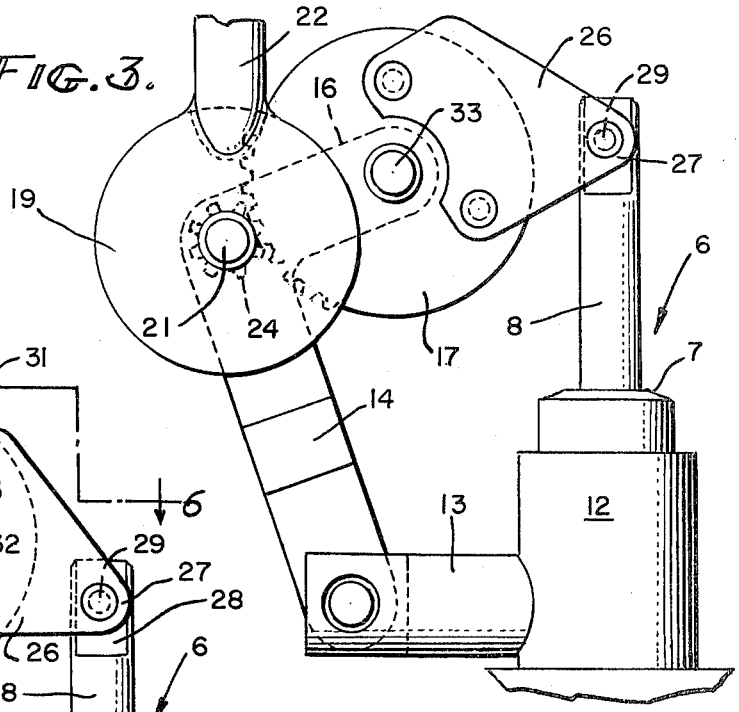
FIG. 3 is a fragmentary elevational view showing the power train and pump assembly in position to commence a power stroke.

It should be noted that for maximum efficiency and to preclude the necessity of users of existing portable hydraulic jacks having to learn a new method of use of such equipment, it is important that when the handle 23 is lifted that this cause elevation of the pump ram 8. Accordingly, as view in FIG. 3, it will be seen that counterclockwise rotation of the handle 23 about the pivot pin 21 causes simultaneous rotation of the gear 24 and the gear segment 17, with consequent rotary displacement of the pressure plates 26 in a counterclockwise direction as viewed in FIG. 3. Such counterclock wise rotation of the pressure plates 26 cause elevation of the pump ram 8 as illustrated. All that is required thereafter to effect axial displacement in a downward direction of the pump ram 8 is to push the handle downwardly, causing counter-clock rotation of the gear 24, clockwise rotation of the gear 17, and coincident clockwise rotary displacement of the pressure plates 26 to effect depression or axial displacement in a downward direction of the pump ram 8.

It should be understood that while plate 19 and gear segment 17 have been illustrated as having a circular configuration, these plates may be fabricated in the form of elongated levers so long as the pivot points are correlated as illustrated in the drawings. Obviously, different sizes of links and gear segments and handles may be utilized to provide whatever requisite mechanical advantage is appropriate for a given hydraulic structure.

Having thus described the invention, what is claimed to be new and novel and desired to be covered by letters patent of the United States is as follows:

1. In combination with a hydraulic jack structure having a main cylinder and a ram movable therewithin by hydraulic fluid and a pump assembly including a pump cylinder and a pump shaft axially displaceable therewithin to pump fluid from within said pump cylinder into said main cylinder by axial displacement of said pump shaft, a pump handle assembly, comprising:

a. link means pivotally mounted on said jack structure;

b. a drive pinion rotatably mounted on said link and including handle receiving means thereon;

c. pressure plate means pivotally mounted on said link and engaged by said drive pinion so that rotation of said drive pinion effects rotation of said pressure plate means one portion of said pressure plate means being pivotally connected to said pump shaft to effect axial displacement thereof when said pressure plate means is caused to rotate.

2. The combination according to claim 1, in which said link means is generally L-shaped, and said drive pinion is pivotally mounted at the intersection of the two legs of the L-shaped link.

3. The combination according to claim 1, in which said link means is generally L-shaped, and said pressure plate means is pivotally mounted on the end of the short leg of the L-shaped link.

4. The combination according to claim 1, in which said drive pinion is related to said pressure plate means so as to provide an approximately 10-to-1 mechanical advantage therebetween.

5. The combination according to claim 1, in which a collet is rotatably mounted on said pump cylinder, and said link means is pivotally mounted on said collet whereby said pump handle assembly may be rotated in a horizontal plane about the axis of said pump shaft.

6. As an article of manufacture, a pump handle assembly for a hydraulic jack structure having a base and a pump assembly including a pump cylinder and a shaft axially displaceable therewithin, comprising:

a. link means adapted to be pivotally mounted on said jack structure for pivotal movement about a horizontal axis;

b. a drive pinion pivotally mounted on said link;

c. handle receiving means fixed to said pinion and adapted to receive a handle actuation of which effects pivotal movement of said drive pinion; and d. pressure plate means pivotally mounted on said link and including a peripheral portion engaged by said pinion and driven thereby when said pinion is caused to pivot, said pressure plate being pivoted to said pump assembly shaft to effect axial displacement thereof when said pinion is caused to rotate.

7. The combination according to claim 1, in which said link is pivotally mounted on said pump cylinder.

8. The combination according to claim 1, in which a collet is provided adapted to be mounted on said pump cylinder for rotation about the axis of said pump shaft, and said link is pivotally mounted on said collet whereby said pump handle assembly may be pivoted with said collet about the pump shaft axis.

9. The combination according to claim 1, in which said handle receiving means includes a plate fixed to said pinion and includes a socket extending radially therefrom to receive a handle therein.

* * * * *